US006076329A

United States Patent [19]

Thomson

[11] Patent Number: 6,076,329

[45] Date of Patent: Jun. 20, 2000

[54] DECORATIVE MIRROR FRAMES

[76] Inventor: Brian K. Thomson, 410 Lookout Pass, Pineville, La. 71360

[21] Appl. No.: 09/139,212

[22] Filed: Aug. 24, 1998

[51] Int. Cl.[7] ..... A47G 1/00

[52] U.S. Cl. ..... 52/785.1; 52/656.1; 52/797.1; 40/798

[58] Field of Search ..... 52/785.1, 36.3, 52/797.1, 657, 656.1; 40/782, 783, 784, 785, 719, 725, 798

[56] References Cited

U.S. PATENT DOCUMENTS

| | | | |
|---|---|---|---|
| D. 24,281 | 5/1895 | Hoort . | |
| D. 24,282 | 5/1895 | Hoort . | |
| D. 24,284 | 5/1895 | Hoort . | |
| D. 109,984 | 6/1938 | Hickerson . | |
| 152,105 | 6/1874 | Hale . | |
| D. 244,137 | 4/1977 | Gorman | D23/138.1 X |
| 481,333 | 8/1892 | Reinfeld . | |
| 1,558,987 | 10/1925 | Kallschuer . | |
| 1,611,003 | 12/1926 | Dearwester . | |
| 1,892,492 | 12/1932 | Molner . | |
| 1,913,817 | 6/1933 | Parmet | 52/785.1 |
| 4,050,498 | 9/1977 | Lucchetti | 52/657 |
| 5,119,603 | 6/1992 | Jones | 52/36 |

*Primary Examiner*—Michael Safavi
*Attorney, Agent, or Firm*—John M. Harrison

[57] ABSTRACT

Decorative mirror frames, each characterized by a typically rectangular wooden frame having a pair of spaced-apart side frame members spanned by top and bottom frame members. Corner blocks overlap the junctions of the side frame members with the top and bottom frame members, respectively, at the corners of the frame. In a preferred embodiment various ornamental designs are provided in the corner blocks and top frame member, and a fluted molding panel is provided on each of the side and or the bottom frame members, between the corner blocks. In another preferred embodiment a mantel shelf or bottom shelf is mounted on the top or bottom frame member, respectively, and in still another preferred embodiment a decorative spindle column is provided on each side frame member, between the top and bottom corner blocks.

27 Claims, 9 Drawing Sheets

DECORATIVE MIRROR FRAMES

BACKGROUND OF THE INVENTION

1. Field of the Invention

This invention relates to mirror frames and more particularly, to sturdy, wooden decorative mirror frames having a typically rectangular frame structure provided with a variety of ornamental designs in the various embodiments. In a preferred embodiment the decorative mirror frames are constructed of wood and each is characterized by a pair of spaced-apart side frame members spanned by top and bottom frame members. Corner blocks, each having a selected configuration, overlap the respective junctions of each side frame member with both the top frame member and the bottom frame member at the corners of the frame, and various ornamental designs are provided in the corner blocks and top frame member. Fluted molding panels are typically provided on the side or the bottom frame members, respectively, between the corner blocks. In other embodiments a mantel shelf is mounted on the top frame member and a bottom shelf on the bottom frame member and in still another embodiment, a decorative spindle column is provided on each side frame member, between the top and bottom corner blocks.

Most decorative mirror frames have evolved over the years from wood to plastic-formed frames. While the various plastics can be formed to simulate almost any appearance and finished to look very similar to wood, the ambiance and luster of wood cannot be reproduced in plastic. Accordingly, the decorative mirror frames of this invention exemplify a variety of wooden mirror frames fitted with rosettes, decorative wood accents, spindle columns, fluted molding, crown molding and the like, to provide a decorative appearance to the frames which cannot be simulated using plastic material. The decorative mirror frames of this invention can be constructed in any desired size and shape to cover a specified area and can be designed for compatibility with the construction of any home, whether contemporary or antebellum. The decorative mirror frames may accommodate a beveled or flat mirror.

2. Description of the Prior Art

Picture and mirror frames having various ornamental designs and configurations are known in the art. U.S. Pat. No. 152,105, dated Jun. 16, 1874, to Henry S. Hale, describes "Picture Frames", each characterized by a rectangular, wooden frame with recesses cut in the side members of the frame. Strips or panels provided with various ornamental designs on opposite sides are removably secured in the recesses to effect a variety of desired appearances of the frame. U.S. Pat. No. 481,333, dated Aug. 23, 1892, to Mayer Reinfeld, discloses a "Frame For Pictures and Similar Purposes", characterized by an elongated base and a perpendicular backing extending from the rear edge of the base. Lower sockets are secured to the backing at each end of the base and upper sockets are secured to the backing above the lower sockets. One or two ornamental rods are inserted between each aligned pair of upper and lower sockets to achieve a selected appearance of the picture frame. A "Mantel" is described and illustrated in Design Pat. No. 24,282, dated May 7, 1895, to John F. A .Hoort. U.S. Pat. No. 1,558,987, dated Oct. 27, 1925, to A. J. Kallscheuer, details a "Picture Frame", characterized by L-shaped corner pieces which are fitted together with top, bottom and side members to form a rectangular picture frame. An ornamental object is provided on each corner piece and an ornamental head piece is provided on the top of the frame. U.S. Pat. No. 1,611,003, dated Dec. 14, 1926, to Frederick G. Dearwester, describes "Decorative Molding", characterized by a pair of corner pieces, each provided with an ornamental design and fitted on respective top corners of a picture frame. A centerpiece is optionally fitted on top of the frame for additional ornamentation. A "Frame" is described in U.S. Pat. No. 1,892,492, dated Dec. 27, 1932, to Herman Molner. The frame is characterized by a rectangular backing shaped with a flange at the bottom for supporting a mirror or picture, and a removable top member includes a groove which fits over the top of the picture and secures the picture to the backing. Vertical frame members of selected configuration can be added to the sides of the frame for decorative purposes. U.S. Design Pat. No. 109,984, dated Jun. 7, 1938, to William J. Hickerson, illustrates a "Mirror". U.S. Design Pat. No. 244,137, dated Apr. 26, 1977, to Sam Gorman, illustrates a "Fireplace Mantel". A "Fireplace Surround Assembly" for installation around a fireplace is described in U.S. Pat. No. 5,119,603, dated Jun. 9, 1992, to Wayne J. Jones. The assembly includes a mantel supported by a pair of columns and is capable of being adjusted vertically and horizontally to accommodate imprecisely-installed fireplaces or non-standard fireplace components. Vertical adjustment of the mantel on the columns is made by moving a front panel upon which the mantel rests, in relation to a horizontal board which spans the columns, and then securing the panel to the board. Horizontal adjustment is accomplished by moving the columns inwardly or outwardly, as desired, before affixing the columns to the wall around the fireplace.

An object of this invention is to provide decorative mirror frames of selected size and shape which are compatible with contemporary fluted and crown molding, spindle columns, rosettes, plinth blocks and decorative wood accents currently used in homes and offices. Each of the decorative mirror frames have a common, typically rectangular construction fitted with a variety of ornamental designs in the various embodiments.

Another object of this invention is to provide sturdy decorative mirror frames, each characterized by spaced-apart side frame members, top and bottom frame members spanning respective ends of the side frame members and corner blocks overlapping the junctions of the side frame members with the top and bottom frame members, respectively, to secure the frame members in a rectangular or square mirror frame and provide various surfaces for decorative features.

Still another object of this invention is to provide decorative mirror frames, each characterized by side, top and bottom frame members forming a rectangular, typically wooden mirror frame and corner blocks overlapping the junctions of the frame members at the respective corners of the frame, with a variety of ornamental designs provided on the frame members and corner blocks in the various embodiments.

Yet another object of this invention is to provide decorative mirror frames of selected size and appearance and optionally provided with a mantel shelf mounted on the top frame member or a bottom shelf on the bottom frame member of a typically square or rectangular mirror frame.

Another object of this invention is to provide decorative mirror frames, each characterized by a generally rectangular, typically wooden frame of selected size, having corner blocks of selected configuration securing top and bottom frame members to spaced-apart side frame members, fluted molding panels or spindle columns provided on the side frame members, and a selected ornamental design shaped in the top frame member and or the corner blocks.

SUMMARY OF THE INVENTION

These and other objects of the invention are provided in sturdy decorative mirror frames each characterized by a rectangular, typically wooden frame of selected size, having a pair of spaced-apart side frame members spanned by top and bottom frame members. Corner blocks having a selected configuration overlap the junctions of the frame members at the respective corners of the frame, and in a preferred embodiment, a rosette or other ornamental design is shaped in two or more of the corner blocks. A decorative wood or plastic composite accent is typically provided in the top frame member and a fluted molding panel may be provided on each side frame member and/or the bottom frame member, between the corner blocks. In another embodiment a mantel or shelf is mounted on either the top or bottom frame member and in still another embodiment, a decorative spindle column is provided on the side frame members.

BRIEF DESCRIPTION OF THE DRAWINGS

The invention will be better understood by reference to the accompanying drawings, wherein.

DESCRIPTION OF THE PREFERRED EMBODIMENTS

Figure 1:
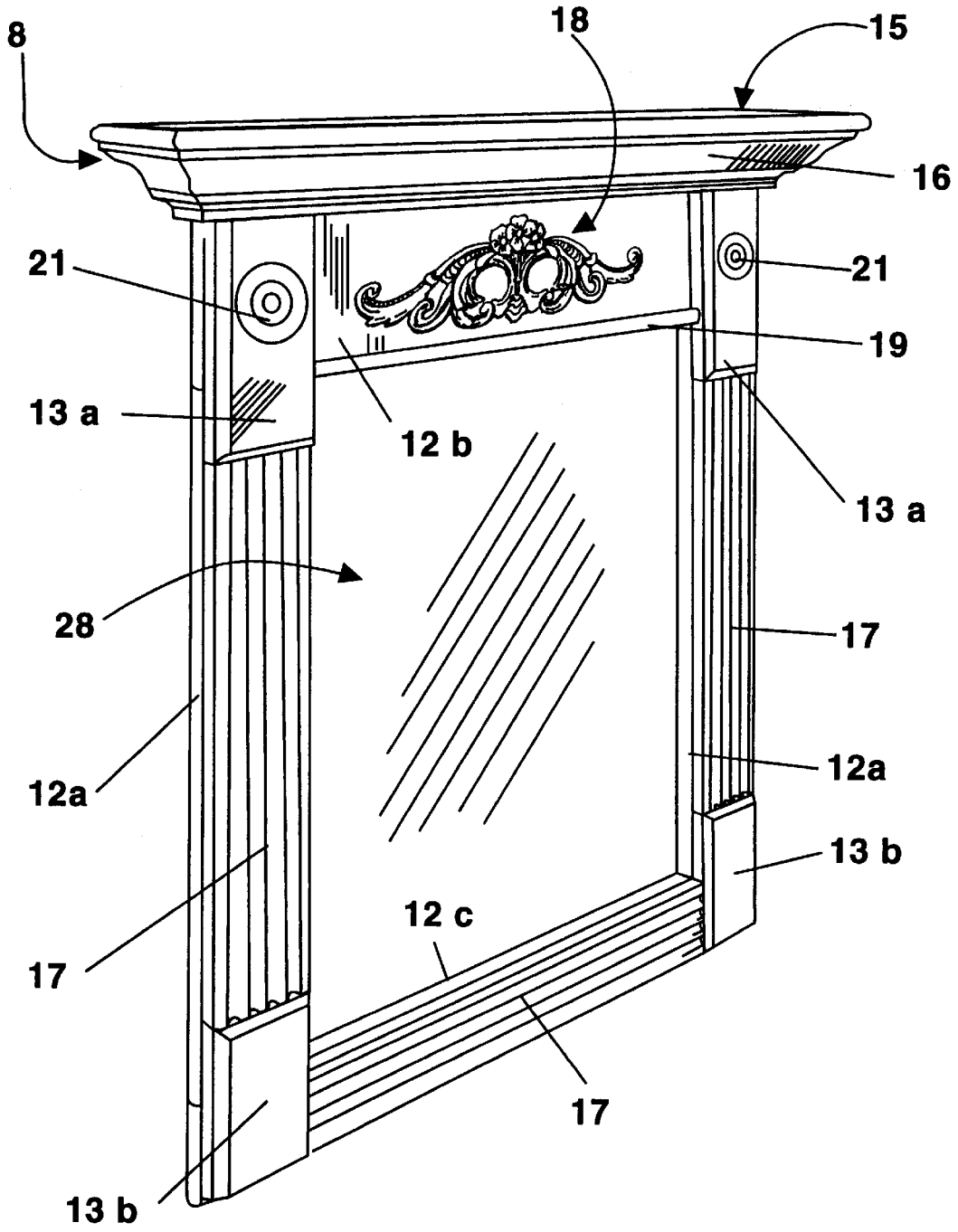
FIG. 1 is a perspective view of a preferred embodiment of the decorative mirror frames of this invention, with a mantel shelf mounted on the top frame member of the mirror frame.
Figure 2:
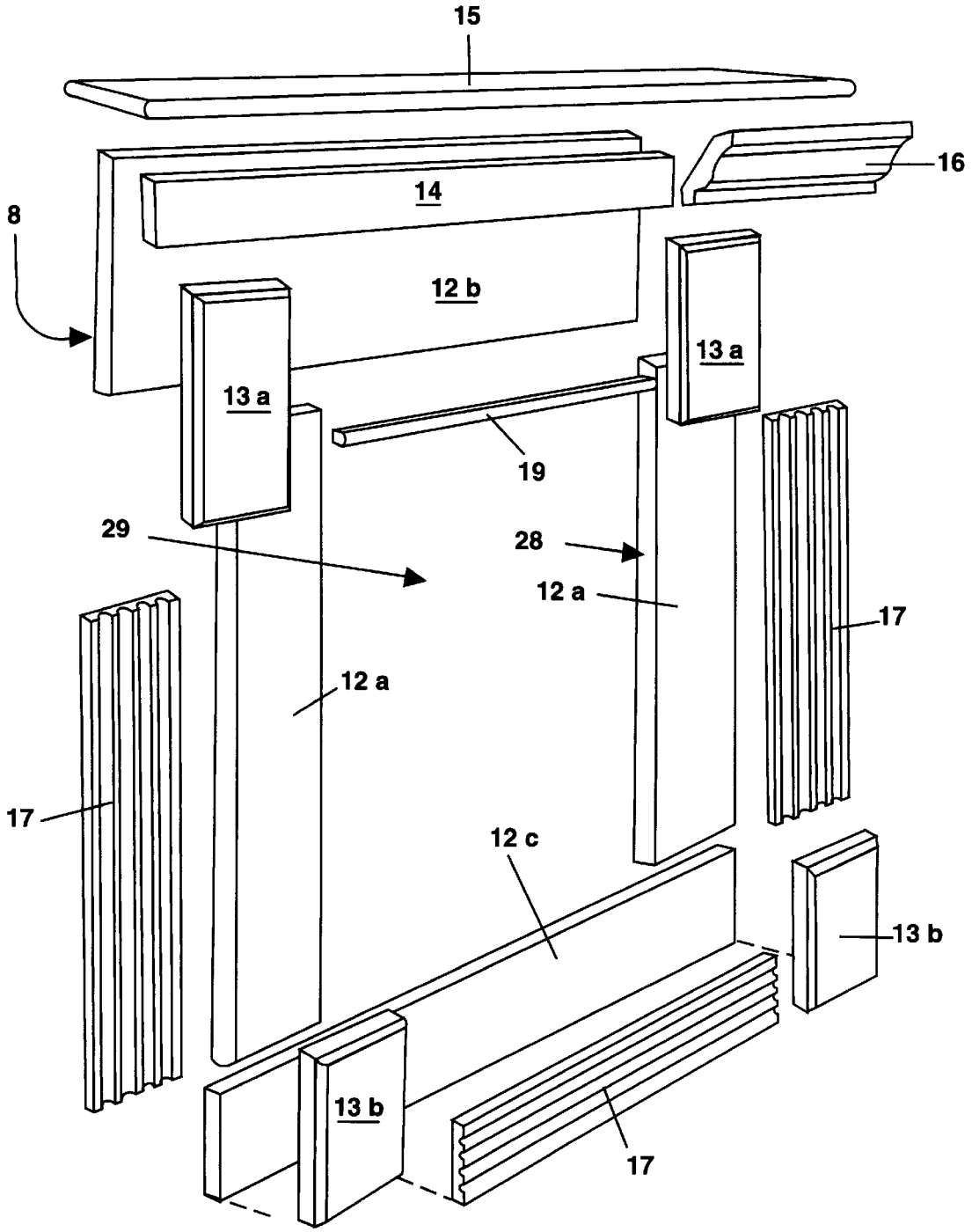
FIG. 2 is an exploded view of the mantel shelf decorative mirror frame illustrated in FIG. 1.
Figure 3:
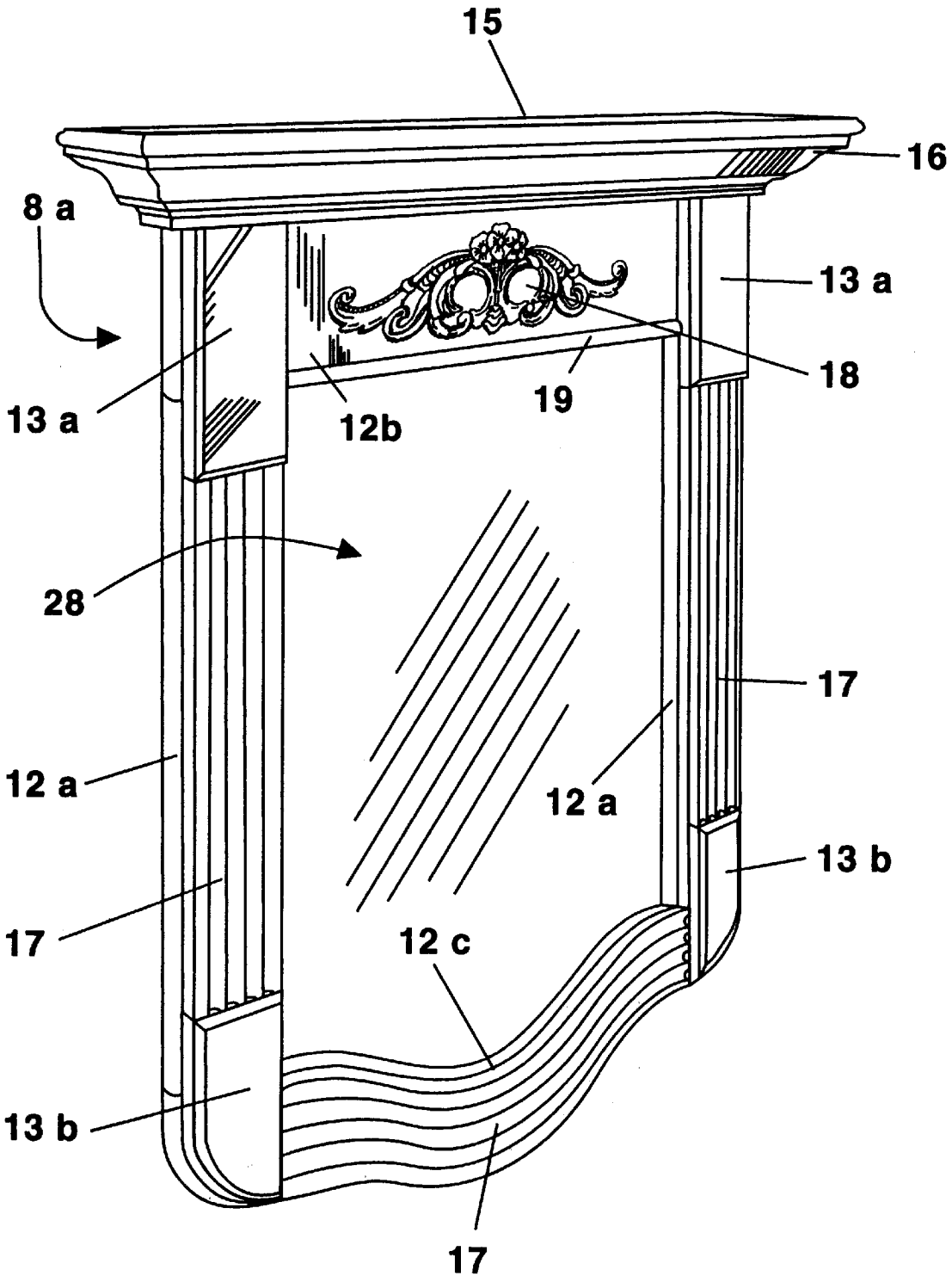
FIG. 3 is a perspective view of a mantel shelf swag decorative mirror frame embodiment of the decorative mirror frame illustrated in FIGS. 1 and 2.
Figure 4:
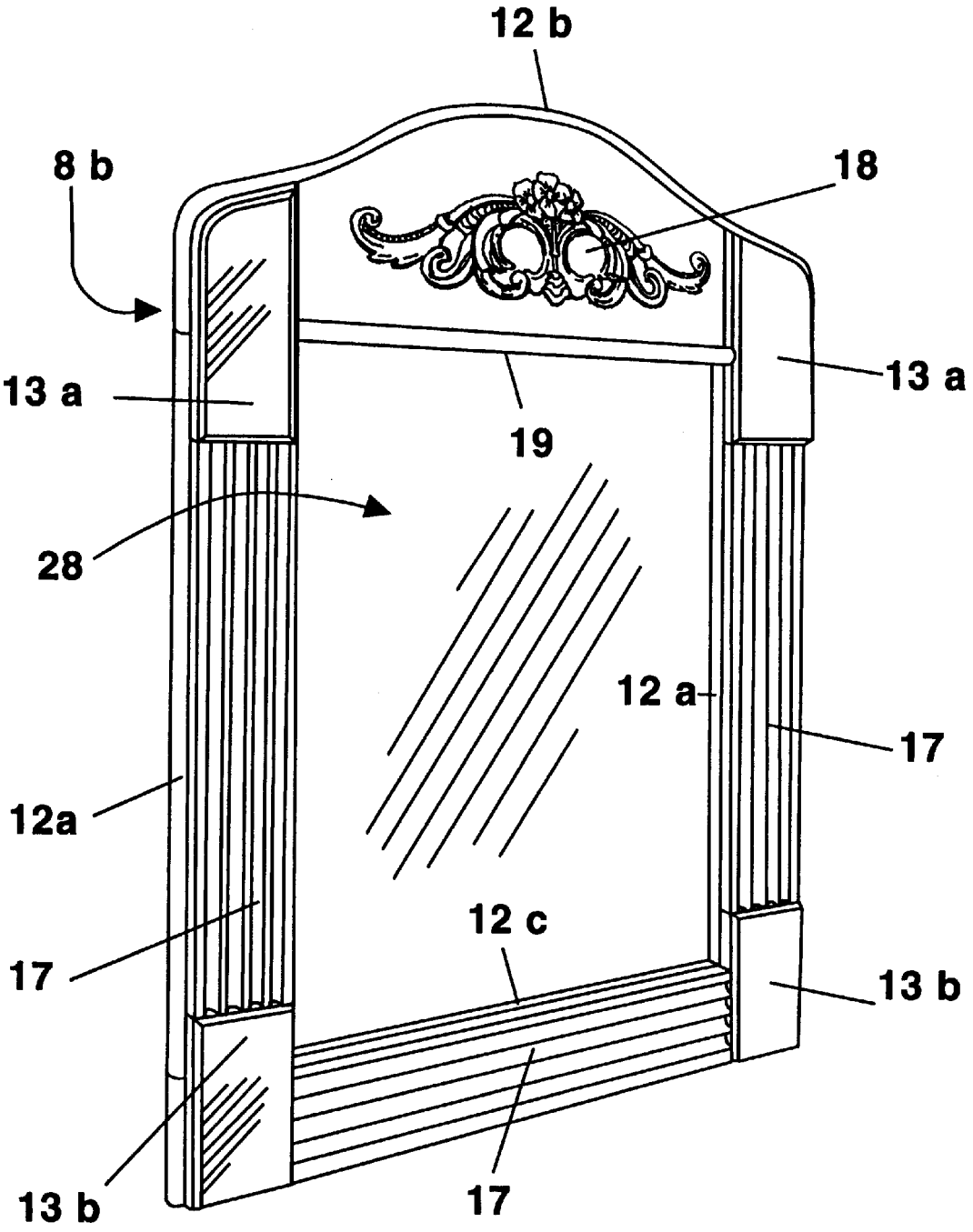
FIG. 4 is a perspective view of a header panel embodiment of the decorative mirror frames, having fluted molding panels mounted on the side and bottom frame members, respectively.
Figure 6:
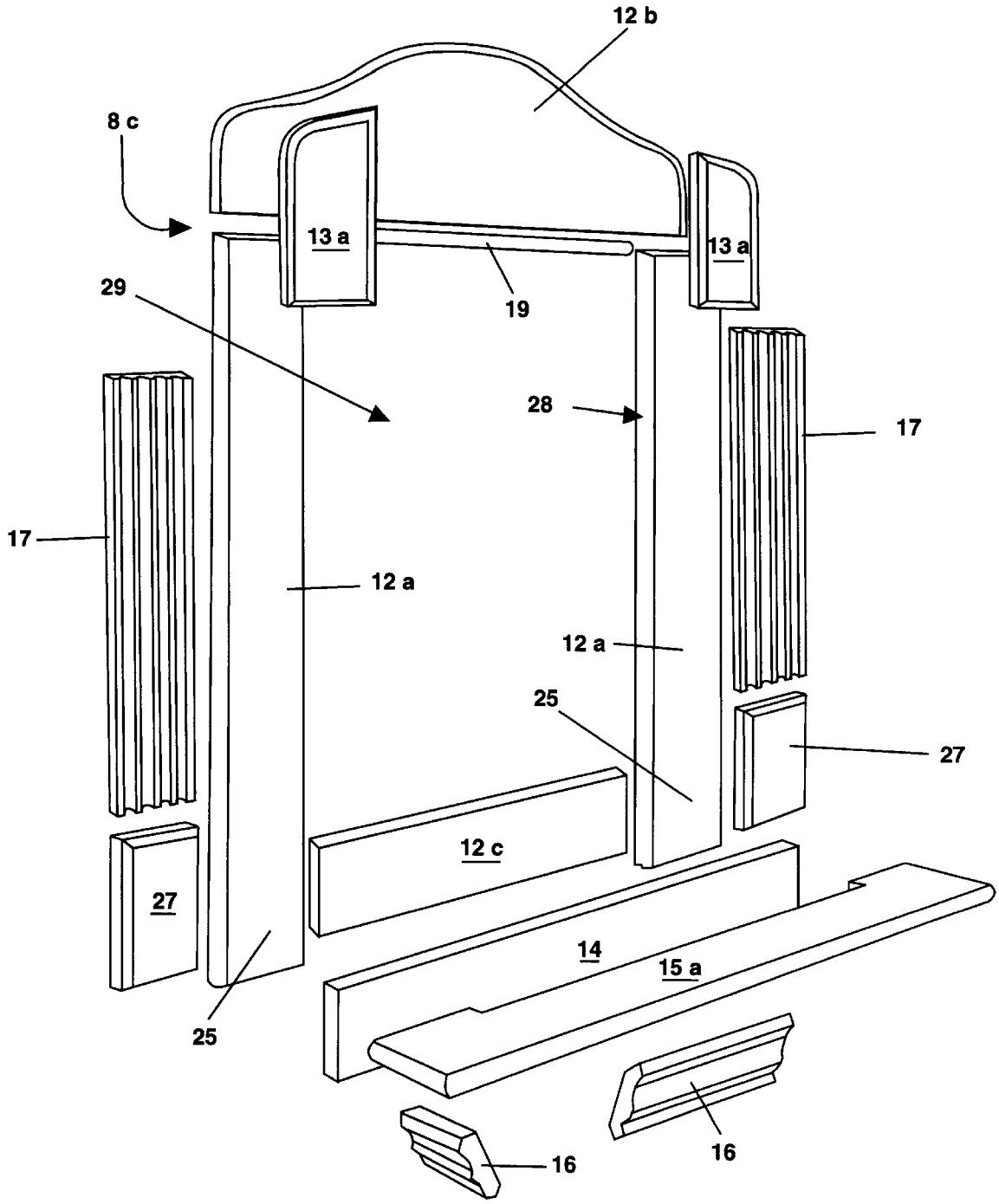
FIG. 6 is an exploded view of the bottom shelf decorative mirror frame illustrated in FIG. 5.

Referring initially to FIGS. 1–3 of the drawings, in a preferred embodiment, the mantel shelf decorative mirror frames illustrated in FIGS. 1 and 2 are each generally illustrated by reference numeral 8 and the mantel shelf swag decorative mirror frame illustrated in FIG. 3, by reference numeral 8*a*. The mantel shelf decorative mirror frames 8 and mantel shelf swag decorative mirror frame 8*a* are constructed typically from oak or other selected wood and as illustrated, include a pair of spaced-apart, parallel side frame members 12*a*. The bottom edge of a top frame member 12*b*, typically having the rectangular configuration illustrated in FIGS. 1–3, is glued or otherwise attached to the top ends of the side frame members 12*a*, and the top edge of a bottom frame member 12*c* is likewise attached to the bottom ends of the side frame members 12*a*, as shown in FIG. 2. (Alternatively, as illustrated in FIG. 6, the bottom frame member 12*c* spans the bottom end portions 25 at the inside edges of the side frame members 12*a* in the bottom shelf decorative mirror frame 8*c*, and is further secured to the side frame members 12*a* by means of a crown molding flush strip 14, as hereinafter described). The side frame members 12*a*, top frame member 12*b* and bottom frame member 12*c* form a mirror opening 28 in the assembled mantel shelf mirror frame 8 and mantel shelf swag decorative mirror frame 8*a*, as illustrated in FIGS. 1 and 3, respectively, for receiving a mirror (not illustrated). A top corner block 13*a*, typically having the rectangular configuration illustrated in FIG. 1 or the tapered configuration illustrated in FIG. 6, is glued to each side frame member 12*a* and the top frame member 12*b*, overlapping the abutting joint, after which nails or screws (not illustrated) are extended through the top frame member 12*b* and corresponding side frame member 12*a*, into the top corner blocks 13*a*. In like manner, bottom corner blocks 13*b* are typically attached to the side frame members 12*a* and bottom frame member 12*c*, as illustrated in FIG. 2, to further secure the side frame members 12*a* and bottom frame member 12*c* in the rectangular mantel shelf decorative mirror frame 8. A rosette 21 or other design is typically carved or stamped in each top corner block 13*a*, as illustrated in FIG. 1, and in each bottom corner block 13*b* or both top corner blocks 13*a* or bottom corner blocks 13*b*, as desired. A decorative wood or plastic composite accent 18 of selected design is typically provided in the top frame member 12*b* of the mantel shelf decorative mirror frame 8 and the mantel shelf swag decorative mirror frame 8*a*, as well as the shelfless header panel decorative mirror frame 8*b*, illustrated in FIG. 4. A shelf strip 19 is provided on the lower edge of the top frame member 12*b*, between the top corner blocks 13*a*, to enhance the appearance of the decorative wood accent 18, as further illustrated in FIG. 4. In a preferred embodiment and referring again to FIGS. 1–4, fluted molding panels 17 are provided on each of the side frame members 12*a*, respectively, between the top corner blocks 13*a* and bottom corner blocks 13*b*, and on the bottom frame member 12*c*, between the bottom corner blocks 13*b* of the respective mirror frames. The fluted molding panel 17 on the bottom frame member 12*c* may have a straight configuration as illustrated in FIGS. 1 and 4, or a curved configuration, as illustrated in FIG. 3, with respect to the mantel shelf swag decorative mirror frame 8*a*.

Figure 1A:
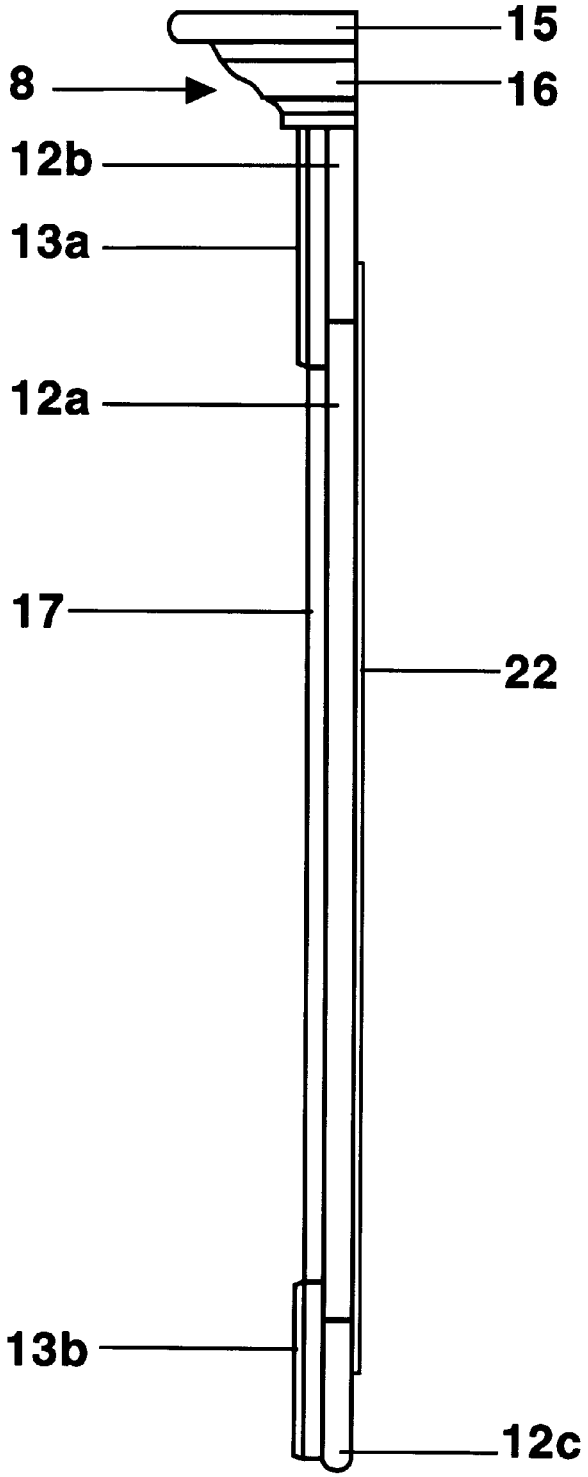
FIG. 1A is a side view of the decorative mirror illustrated in FIG. 1.
Figure 7:
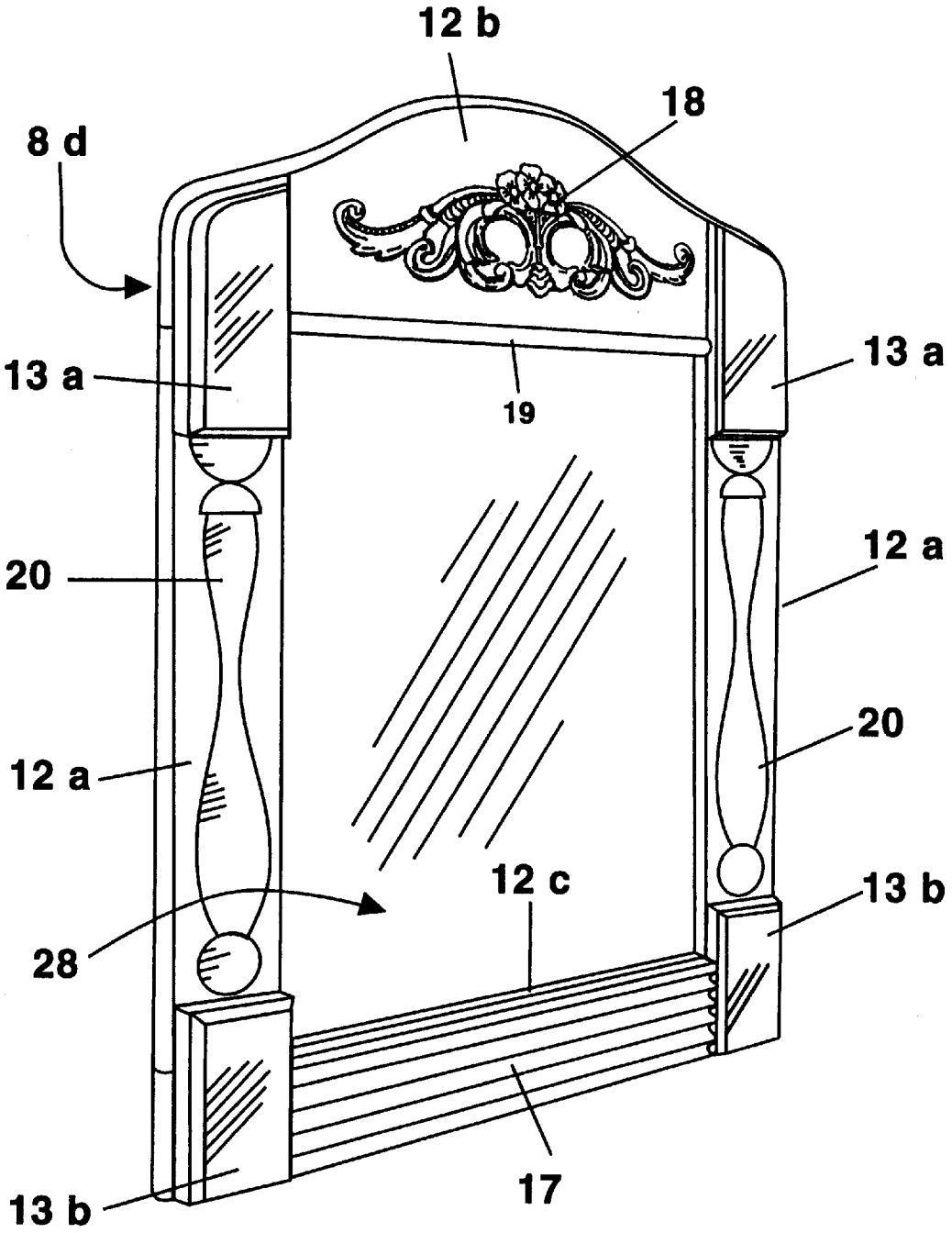
FIG. 7 is a perspective view of a spindle column embodiment of the decorative mirror frames, with an ornamental spindle column mounted on the side frame members of the frame.

In another embodiment, the spindle column decorative mirror frame 8*d* illustrated in FIG. 7 has a decorative wood or plastic composite accent 18 and a pair of ornamental spindle columns 20, typically shaped from wood and glued or otherwise secured to each side frame member 12*a*. A beveled or flat mirror 29, sized to fit on the mirror frame 8 over the mirror opening 28 (FIGS. 2 and 6), is secured to the rear surfaces of the side frame members 12*a*, top frame member 12*b* and bottom frame member 12*c*, typically by use of a backing 22, illustrated in FIGS. 1A and 5A in conventional fashion, according to the knowledge of those skilled in the art.

Figure 5:
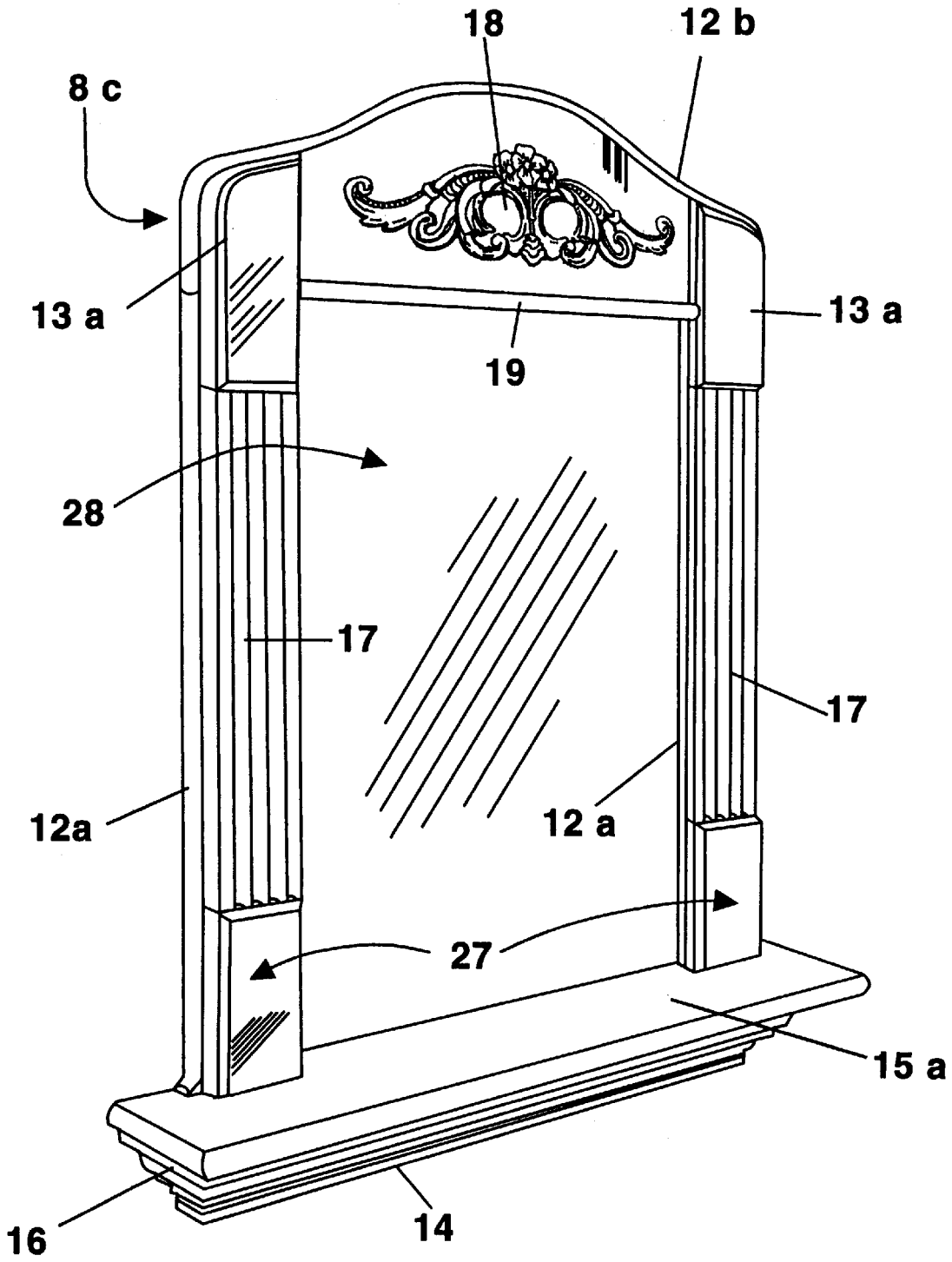
FIG. 5 is a perspective view of a bottom shelf embodiment of the decorative mirror frames, with a mantel shelf provided on the bottom frame member of the frame.
Figure 5A:
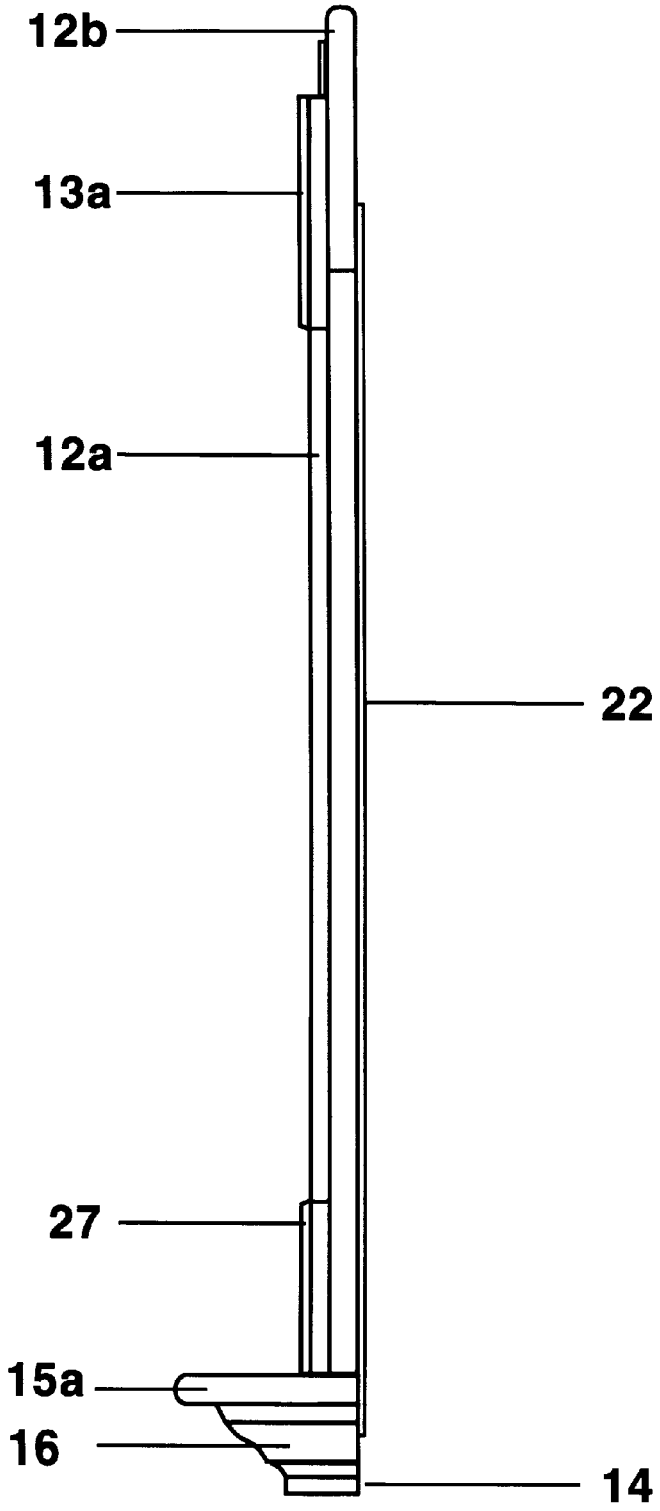
FIG. 5A is a side view of the decorative mirror frame illustrated in FIG. 5.

Referring again to FIGS. 1–3 of the drawings, in a preferred embodiment of the mantel shelf decorative mirror frame 8 and mantel shelf swag decorative mirror frame 8*a*, a mantel shelf 15 is mounted on the top frame member 12*b*. Moreover, as illustrated in FIGS. 5 and 6, a similar bottom shelf 15*a* is attached to the bottom frame member 12*c* in the bottom shelf decorative mirror frame 8*c*. When the mantel shelf 15 is mounted on the top frame member 12*b* as illustrated in FIGS. 1–3, an elongated, crown molding flush strip 14 is typically first attached by glue or nails to the top frame member 12*b*, as illustrated in FIG. 2. The crown molding flush strip 14 provides a continuous surface for addition of crown molding 16 to the top frame member 12*b* and the mantel shelf 15, as illustrated in FIGS. 1–3, and further provides structural stability to the mantel shelf 15. When the bottom shelf 15*a* is mounted on the bottom frame member 12*c* as illustrated in FIG. 5, the bottom corner blocks 13*b* are typically omitted from the mantel shelf decorative mirror frame 8 and the crown molding flush strip 14 overlaps and reinforces the connection of the side frame members 12*a* to the bottom frame member 12*c*, as further illustrated in FIG. 6. Crown molding 16 may also be added to the crown molding flush strip 14 bottom shelf 15*a* interface, as illustrated. In that case, as further illustrated in FIG. 5, a block 27 is optionally secured to each side frame member 12*a*, above the bottom shelf 15*a*, for decorative purposes, as desired.

It will be appreciated by those skilled in the art that the decorative mirror frames 8 of this invention can be constructed in various sizes, colors and shapes to provide decor and personality to any room in a home or office. Futhermore, solids, veneers or wood composites can be used in the construction of the various components of the decorative mirror frames 8–8*d*, and the various component parts can be glued and/or nailed in place or attached by screws, as desired.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A decorative mirror frame comprising a pair of spaced-apart side frame members; a top frame member spanning one end of said side frame members and a bottom frame member spanning the other end of said side frame members; a pair of top corner blocks carried by said side frame members, respectively, at selected junctions of said side frame members with said top frame member and said bottom frame member, said corner blocks disposed in overlapping relationship with respect to said top frame member and said side frame members; and a rosette shaped in said top corner blocks, respectively.

2. The decorative mirror frames of claim 1 comprising at least one decorative accent shaped in said top frame member.

3. The decorative mirror frames of claim 1 comprising a mantel shelf carried by said top frame member.

4. The decorative mirror frames of claim 1 comprising a bottom shelf carried by said bottom frame member.

5. A decorative mirror frame comprising a pair of spaced-apart side frame members; a top frame member spanning one end of said side frame members and a bottom frame member spanning the other end of said side frame members; two top corner blocks carried by said side frame members, respectively, and said top frame member in overlapping relationship with respect to said top frame member and said side frame members, and two bottom corner blocks carried by said side frame members, respectively, and said bottom frame member in overlapping relationship with respect to said bottom frame member and said side frame members; and a fluted molding panel provided on each of said side frame members between said top corner blocks and said bottom corner blocks, respectively.

6. The decorative mirror frames of claim 5 comprising a decorative accent shaped in said top frame member.

7. The decorative mirror frames of claim 5 comprising a mantel shelf carried by said top frame member.

8. The decorative mirror frames of claim 5 comprising a decorative accent shaped in said top frame member and a mantel shelf carried by said top frame member.

9. The decorative mirror frames of claim 5 comprising a bottom shelf carried by said bottom frame member.

10. The decorative mirror frames of claim 9 comprising a decorative accent shaped in said top frame member.

11. The decorative mirror frames of claim 5 comprising a rosette shaped in each of said top corner blocks.

12. The decorative mirror frames of claim 11 comprising a decorative accent shaped in said top frame member.

13. The decorative mirror frames of claim 11 comprising a mantel shelf carried by said top frame member.

14. The decorative mirror frames of claim 11 comprising a decorative accent shaped in said top frame member and a mantel shelf carried by said top frame member.

15. The decorative mirror frames of claim 11 comprising a bottom shelf carried by said bottom frame member.

16. The decorative mirror frames of claim 15 comprising a decorative accent shaped in said top frame member.

17. A decorative mirror frame comprising a substantially rectangular, wooden frame having a pair of spaced-apart side frame members, a top frame member spanning one end of said side frame members and a bottom frame member spanning the other end of said side frame members; two top corner blocks carried by said side frame members, respectively, and said top frame member in overlapping relationship with respect thereto and two bottom corner blocks carried by said side frame members, respectively, and said bottom frame member in overlapping relationship with respect thereto; and a spindle column provided on each of said side frame members between said top corner blocks and said bottom corner blocks, respectfully.

18. The decorative mirror frames of claim 17 comprising a mantel shelf carried by said top frame member.

19. The decorative mirror frames of claim 17 comprising a decorative accent shaped in said top frame member.

20. The decorative mirror frames of claim 17 comprising a mantel shelf carried by said top frame member and a decorative accent shaped in said top frame member.

21. The decorative mirror frames of claim 17 comprising a bottom shelf carried by said bottom frame member.

22. The decorative mirror frames of claim 21 comprising a decorative accent shaped in said top frame member.

23. The decorative mirror frames of claim 17 comprising a rosette shaped in each of said top corner blocks.

24. The decorative mirror frames of claim 23 comprising a mantel shelf carried by said top frame member.

25. The decorative mirror frames of claim 24 comprising a decorative accent shaped in said top frame member.

26. The decorative mirror frames of claim 23 comprising a bottom shelf carried by said bottom frame member.

27. The decorative mirror frames of claim 26 comprising a decorative accent shaped in said top frame member.

* * * * *